US007241402B2

(12) United States Patent
Mori et al.

(10) Patent No.: US 7,241,402 B2
(45) Date of Patent: Jul. 10, 2007

(54) ORGANIC POSITIVE TEMPERATURE COEFFICIENT THERMISTOR

(75) Inventors: Yukie Mori, Tokyo (JP); Satoshi Shirai, Tokyo (JP); Tokuhiko Handa, Ichikawa (JP)

(73) Assignee: TDK Corporation, Tokyo (JP)

( * ) Notice: Subject to any disclaimer, the term of this patent is extended or adjusted under 35 U.S.C. 154(b) by 108 days.

(21) Appl. No.: 11/092,643

(22) Filed: Mar. 30, 2005

(65) Prior Publication Data

US 2005/0237148 A1 Oct. 27, 2005

(30) Foreign Application Priority Data

Mar. 31, 2004 (JP) ..... P2004-107791
Mar. 31, 2004 (JP) ..... P2004-107888

(51) Int. Cl.
*H01B 1/00* (2006.01)

(52) U.S. Cl. ..... 252/500; 338/22 R

(58) Field of Classification Search ..... 252/500; 338/34

See application file for complete search history.

(56) References Cited

U.S. PATENT DOCUMENTS 4,966,729 A 10/1990 Caramona et al.
5,250,228 A 10/1993 Baigrie et al.
6,191,681 B1 2/2001 Cole et al.
6,375,867 B1 * 4/2002 Smith et al. ..... 252/511
6,459,358 B1 10/2002 Shea et al.

FOREIGN PATENT DOCUMENTS

EP 0 896 344 A2 2/1999
JP B2 3101047 8/2000
JP B2 3101048 8/2000
WO WO 2004/086421 A1 10/2004

* cited by examiner

*Primary Examiner*—Mark Kopec
*Assistant Examiner*—Jaison Thomas
(74) *Attorney, Agent, or Firm*—Oliff & Berridge, PLC

(57) ABSTRACT

The invention provides an organic positive temperature coefficient thermistor provided with a pair of mutually opposing electrodes and a thermistor element with a positive resistance-temperature characteristic situated between the pair of electrodes, wherein said thermistor element contains a cured body derived from a mixture comprising an epoxy resin, a curing agent and conductive particles, and there is included in the epoxy resin and/or curing agent a compound which imparts flexibility to the cured body.

6 Claims, 1 Drawing Sheet

ORGANIC POSITIVE TEMPERATURE COEFFICIENT THERMISTOR

BACKGROUND OF THE INVENTION

1. Field of the Invention

The present invention relates to an organic positive temperature coefficient thermistor having a PTC positive Temperature Coefficient) characteristic such that the resistance value increases drastically with increasing temperature.

2. Related Background Art

Thermoplastic resins are widely known as matrix materials for thermistor elements used in organic positive temperature coefficient thermistors. However, because thermoplastic resins require crosslinking treatment and noncombustible treatment to achieve heat resistance, the production steps for such thermistor elements are complex. As a result, attention has shifted toward thermosetting resins as matrix materials which can simplify the production process by eliminating such treatment.

Examples of hitherto studied organic positive temperature coefficient thermistors employing thermosetting resins which have been disclosed include types wherein a fibrous conductive substance is dispersed in a thermosetting resin (for example, U.S. Pat. No. 4,966,729), types wherein conductive particles with spike-like protrusions are dispersed in a thermosetting resin (for example, Japanese Patent Publication No. 3101047), and types wherein conductive particles with spike-like protrusions and conductive staple fibers are dispersed in a thermosetting resin (for example, Japanese Patent Publication No. 3101048).

SUMMARY OF THE INVENTION

Organic positive temperature coefficient thermistors can be utilized in overcurrent/overheat protection elements, autoregulating heating elements, temperature sensors and the like. The characteristics required for such devices include an adequately low room temperature resistance value, and a sufficiently large resistance value change ratio for the PTC characteristic. Additional properties that are required include a low resistance value change ratio with repeated operation (small difference between room temperature resistance value at initial use and room temperature resistance value after repeated operation) and excellent "reliability", or recovery of the room temperature resistance value in the presence of heating and cooling, and it has therefore been a desired goal to develop an organic positive temperature coefficient thermistor capable of exhibiting these characteristics.

However, in constructions which employ conventional thermosetting resins and conventional conductive particles, including the organic positive temperature coefficient thermistor described in Patent document 1, it is difficult to reduce the room temperature resistance value while adequately maintaining the change ratio of the resistance value for the PTC characteristic, and consequently it has not been possible to achieve satisfactory characteristics.

Also, when it is attempted to achieve practical levels of both room temperature resistance value and resistance value change ratio in the organic positive temperature coefficient thermistors described in Patent documents 2 and 3, it has not been possible to achieve satisfactory reliability, such as recovery of the room temperature resistance value in the presence of heating and cooling, and recovery of the resistance value under repeated operation (intermittent load characteristic), which are important properties of organic positive temperature coefficient thermistors.

In addition, the increasing miniaturization of organic positive temperature coefficient thermistors has led to smaller electrode areas and consequently increased room temperature resistance values. Methods for dealing with this include reducing the distance between electrodes and increasing the conductive particle content in thermistor elements. With the organic positive temperature coefficient thermistors described in Patent documents 2 and 3, however, it has been experimentally confirmed that an adequate resistance change ratio cannot be achieved by using these methods to lower the room temperature resistance value (see Comparative Examples 3-5 of the present specification).

It is particularly desirable for the room temperature resistance value to be low when an organic positive temperature coefficient thermistor is used in an overcurrent/overheat protection element. In the organic positive temperature coefficient thermistors of the prior art described above, it has been difficult to achieve the desired PTC characteristic when the room temperature resistance value is set to be 10 mΩ or lower. Furthermore, conventional organic positive temperature coefficient thermistors have been unsatisfactory from a reliability standpoint, in terms of stably obtaining the prescribed room temperature resistance value.

The present invention has been accomplished in light of the aforementioned problems of the prior art, and its object is to provide an organic positive temperature coefficient thermistor have an adequately low room temperature resistance value, a sufficiently large resistance value change ratio for the PTC characteristic, and excellent reliability.

As a result of much diligent research conducted with the aim of achieving the object stated above, the present inventors have completed the present invention upon discovering that if a thermistor element of an organic positive characteristic thermistor is formed from a mixture whose constituent materials include a specific component comprising a compound exhibiting a specific effect, it is possible to simultaneously achieve the desired room temperature resistance value and the desired resistance change ratio in the obtained organic positive temperature coefficient thermistor, and the resulting reliability is excellent.

The organic positive temperature coefficient (hereinafter referred to as "PTC") thermistor of the invention is provided with a pair of mutually opposing electrodes and a thermistor element with a positive resistance-temperature characteristic situated between the pair of electrodes, wherein the thermistor element contains a cured body derived from a mixture comprising an epoxy resin, a curing agent and conductive particles, and there is included in the epoxy resin and/or curing agent a compound which imparts flexibility to the cured body.

The present inventors believe that repeated heating- and is cooling-induced expansion and contraction of matrices composed of thermosetting resins (for example, epoxy resins) in conventional organic PTC thermistors leads to gradual alterations in the resin structure and a reduced thermal expansion coefficient and contraction coefficient. This is conjectured to be one of the major causes of the aforementioned problem associated with conventional organic PTC thermistors. In the organic PTC thermistor of the invention, on the other hand, the compound included in the matrix of the thermistor element imparts suitable flexibility to the thermistor element. The present inventors believe that this provides an effect whereby it is possible to adequately reduce the room temperature resistance value of the organic PTC thermistor, sufficiently increase the resistance value change ratio for the PTC characteristic, and produce excellent reliability for the organic PTC thermistor.

Whether or not the compound "imparts flexibility to the cured body" is judged by whether or not the conditions determined by the following method are satisfied Specifically, in order to judge a compound included in the epoxy resin, first a mixture of the epoxy resin, the compound to be judged as imparting or not imparting flexibility to the cured body, and succinic anhydride as a curing agent, mixed in an equivalent ratio of 1:1, is heat treated to form a cured body P. Separately, a mixture of bisphenol A type epoxy resin as an epoxy resin and succinic anhydride as a curing agent, mixed in an equivalent ratio of 1:1, is heat treated to form a separate cured body Q. If the flexural modulus E1 (Pa) of the cured body P at 25° C. Satisfies inequality (A) below with respect to the flexural modulus E0 (Pa) of the cured body Q at 25° C., then the epoxy resin is judged to "impart flexibility to the cured body".

$$(E1/E0)<1 \quad (A)$$

E1 and E0 are the values measured based on a flexural modulus measuring method.

In order to judge a compound included in the curing agent, first a mixture of a specific epoxy resin and the curing agent, as the compound to be judged as imparting or not imparting flexibility to the cured body, mixed in an equivalent ratio of 1:1, is heat treated to form a cured body R. Separately, a mixture of the specific epoxy resin and succinic anhydride as a curing agent, mixed in an equivalent ratio of 1:1, is heat treated to form a separate cured body S. If the flexural modulus E3 (ha) of the cured body R at 25° C. Satisfies inequality (B) below with respect to the flexural modulus E2 (Pa) of the cured body S at 25° C., then the curing agent is judged to "impart flexibility to the cured body"

$$(E3/E2)<1 \quad (B)$$

E3 and E2 are the values measured based on a flexural modulus measuring method.

A compound satisfying such condition may be judged as "a compound which imparts flexibility to the cured body" according to the invention.

In the organic PC thermistor of the invention, the epoxy resin preferably contains a compound represented by the following general formula (1).

(1)

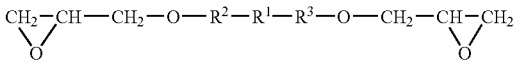

In formula (1), $R^1$, $R^2$ and $R^3$ each represent a single bond or a divalent organic group and at least one from among $R^1$, $R^2$ and $R^3$ includes an optionally substituted C2 or greater divalent chain group, or alternatively $R^1$, $R^2$ and $R^3$ in formula (1) each represent a single bond or a divalent organic group and at least one from among $R^2$ and $R^3$ includes an optionally substituted C1 or greater divalent hydrocarbon group bonded to the glycidyl ether group.

According to the invention, "chain group" means a group having a chain structure with no cyclic structures on the main chain, and having the atoms of the main chain arranged in a linear fashion, although optionally it may have a branched structure. The atoms composing the main chain may consist solely of carbon, such as in saturated hydrocarbon groups or unsaturated hydrocarbon groups, or alternatively hetero atoms such as oxygen, sulfur or nitrogen may be included within the main chain skeleton.

The term "C2 or greater divalent chain group" used according to the invention refers to a divalent chain group having two or more carbon atoms composing the main chain The organic PTC thermistor has, in its thermistor element, conductive particles dispersed in a matrix formed from an epoxy resin containing a compound represented by general formula (1) above, and a curing agent. This allows the room temperature resistance value of the organic PTC thermistor to be further reduced, allows the resistance value change ratio for the PTC characteristic to be further increased, and can result in more excellent reliability of the organic PTC thermistor. The present inventors believe that the aforementioned effect is achieved as a result of incorporating the compound represented by general formula (1) above into the matrix of the thermistor element of the organic PTC thermistor, whereby suitable flexibility is imparted to the thermistor element.

In the organic PTC thermistor of the invention, the epoxy resin preferably contains a compound represented by the following general formula (2).

(2)

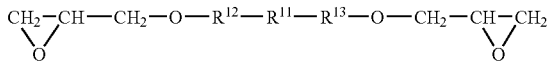

In formula (2), $R^{11}$ represents an optionally substituted C1-20 divalent chain group, and $R^{12}$ and $R^{13}$ may be the same or different and each represents a divalent organic group represented by the following general formula (a) or (b).

$$—(Ar—X^1)— \quad (a)$$

In formula (a), Ar represents an optionally substituted divalent 5-membered cyclic group, 6-membered cyclic group, naphthalene group or anthracene group, and $X^1$ represents a C1 or greater divalent chain group.

$$—Y^1— \quad (b)$$

In formula (b), $Y^1$ represents an optionally substituted C1 or greater divalent chain group containing a carbon atom bonded to the glycidyl ether group.

This type of construction for an organic PTC thermistor also allows the room temperature resistance value of the organic PTC thermistor to be further reduced, allows the resistance value change ratio for the PTC characteristic to be further increased, and can result in more excellent reliability of the organic PTC thermistor. The present inventors believe that these effects are, as described above, a result of incorporating the compound represented by general formula (2) above into the matrix of the thermistor element, so that suitable flexibility is imparted to the thermistor element.

A preferred organic PTC thermistor of the invention is one wherein in general formula (2) above, $R^{11}$ is a divalent organic group represented by $—CH_2—$, $—CH(CH_3)—$ or $—C(CH_3)_2—$, and $R^{12}$ and $R^{13}$ are divalent organic groups represented by general formula (a) above wherein Ar in general formula (a) is $—C_6H_4—$.

By using such compounds, it is possible to achieve the aforementioned effects of the invention while obtaining with greater certainty an organic PTC themistor exhibiting excellent heat resistance.

In the organic PTC thermistor of the invention, the epoxy resin preferably contains a compound represented by the following general formula (3).

(3)

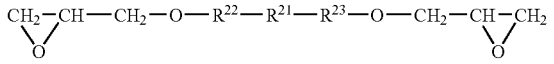

In formula (3), $R^{21}$ represents an optionally substituted C1-20 divalent chain group, and $R^{22}$ and $R^{23}$ each represent a single bond or a divalent organic group, where at least one of $R^{22}$ and $R^{23}$ contains at least one structural unit selected from the group consisting of —$CH_2CH_2O$—, —$CH_2CH(CH_3)O$—, —$CH(CH_3)CH_2O$—, —SiO—, —CH═CH—, —CH═CH—CH═CH—, —CH═C(CN)—, —$CH_2O$—, —$CH_2S$—, —NH—CO—O—, —CO—O—, —CH═N— and —O—CO—O—.

This type of construction for an organic PTC thermistor also allows the room temperature resistance value of the organic PTC thermistor to be further reduced, allows the resistance value change ratio for the PTC characteristic to be further increased, and can result in more excellent reliability of the organic PTC thermistor. The present inventors believe that these effects are, as described above, a result of incorporating the compound represented by general formula (3) above into the matrix of the thermistor element, so that suitable flexibility is imparted to the thermistor element.

In the organic PTC thermistor of the invention, the epoxy resin preferably contains a compound represented by the following general formula (4).

(4)

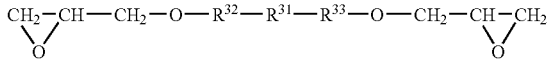

In formula (4), $R^{31}$ represents an optionally substituted C1-20 divalent chain group, and $R^{32}$ and $R^{33}$ each represent a single bond or a divalent organic group, where at least one of $R^{32}$ and $R^{33}$ contains at least one structural unit selected from the group consisting of —$CH_2$—, —$CH_2CH_2O$—, —$CH_2CH(CH_3)O$—, —$CH(CH_3)CH_2O$—, —SiO—, —CH═CH—, CH═CH—CH═CH—, —CH═C(CN)—, —$CH_2O$—, —$CH_2S$—, —NH—CO—, —NH—CO—O—, —CO—O— and —CH═N—, wherein the structural unit is bonded to the glycidyl ether group.

This type of construction for an organic PTC thermistor also allows the room temperature resistance value of the organic PTC thermistor to be further reduced, allows the resistance value change ratio for the PTC characteristic to be further increased, and can result in more excellent reliability of the organic PTC thermistor. The present inventors believe that these effects are, as described above, a result of incorporating the compound represented by general formula (4) above into the matrix of the thermistor element, so that suitable flexibility is imparted to the thermistor element.

Preferably, at least one of $R^{32}$ and $R^{33}$ in general formula (4) above contains a structural unit represented by the following general formula (5), wherein the structural unit is bonded to the glycidyl ether group.

$$—(R^4—O)_n— \quad (5)$$

In formula (5), $R^4$ represents a C1-20 divalent hydrocarbon group, and n is an integer of 1-10.

This makes it possible to obtain with greater certainty and ease an organic PTC thermistor having the desired room temperature resistance value and the desired resistance change ratio, as well as excellent reliability.

The component which imparts flexibility to the cured body in the curing agent of the organic PTC thermistor of the invention preferably comprises an acid anhydride.

In an organic PTC thermistor according to the invention, the thermistor element has conductive particles dispersed in a matrix formed from an epoxy resin and a curing agent The formed matrix is imparted with flexibility by the acid anhydride in the curing agent. This allows the room temperature resistance value of the organic PTC thermistor to be further reduced, allows the resistance value change ratio for the PTC characteristic to be further increased, and can result in more excellent reliability of the organic PTC thermistor.

According to the invention, (E3/E2) is preferably 0.2-0.8. If (E3/E2) is greater than 0.8 it will tend to be difficult to achieve the effect of the invention, and if it is less than 0.2, the mechanical strength of the thermistor element will tend to be lower.

An acid anhydride is used because it has an effect of lowering the room temperature resistance value in an organic PTC thermistor employing an epoxy resin, and because it imparts heat resistance and reduces the viscosity for improved workability.

The acid anhydride in an organic PTC thermistor of the invention is preferably a compound represented by the following general formula (I), or a compound comprising one or more structural units represented by one or more of the following general formulas (II) to (IV).

(I)

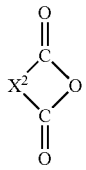

In formula (I), $X^2$ represents a divalent organic group with at least one C4 or greater hydrocarbon group.

(II)

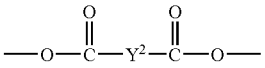

In formula (II), $Y^2$ represents a C4 or greater divalent hydrocarbon group.

(III)

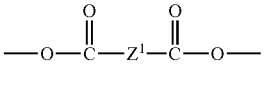

In formula (III), $Z^1$ represents a C2 or greater divalent hydrocarbon group.

(IV)

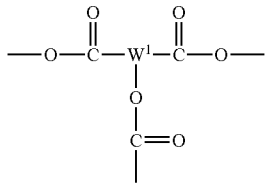

In formula (IV), $W^1$ represents a C3 or greater trivalent hydrocarbon group.

According to the invention, the acid anhydride is preferably one or more selected from the group consisting of dodecenylsuccinic anhydride, polyadipic anhydride, polyazelaic anhydride, polysebacic anhydride, poly(ethyloctadecanedioic)anhydride, poly(phenylhexadecanedioic)anhydride, 2,4-diethylglutaric anhydride, ethyleneglycol bisanhydrotrimellitate and glycerol tristrimellitate.

By using such an acid anhydride it is possible to obtain with greater certainty and ease an organic PTC thermistor having the desired room temperature resistance value and the desired resistance change ratio, as well as excellent reliability. The present inventors believe that this occurs because of a more favorable degree of flexibility of the thermistor element, which affects the resistance change ratio of the organic PTC thermistor and the recovery of the room temperature resistance value in the presence of heating and cooling.

The conductive particles used according to the invention are not particularly restricted so long as they are electron conductive, and for example, there may be used carbon black, graphite, metal particles of various shapes and ceramic-based conductive particles. As materials for metal particles there may be mentioned copper, aluminum, nickel, tungsten, molybdenum, silver, zinc, cobalt and nickel-plated copper powder. As materials for ceramic-based conductive particles there may be mentioned TiC and WC. These materials may be used alone or in combinations of two or more different types. Metal particles are preferably used for the invention. When metal particles are used as the conductive particles it is possible to adequately ensure the resistance change ratio of the thermistor and further reduce the room temperature resistance value, and this is preferred when, for example, the thermistor of the invention is to be used as an overcurrent protection element The conductive particles may be in the form of spheres, flakes, fibers, rods or the like, but particles having surface spike-like protrusions are preferred Using conductive particles having spike-like protrusions will facilitate flow of tunnel current between adjacent particles, so that the resistance change ratio of the organic PTC thermistor can be adequately ensured and the room temperature resistance value can be reduced with greater certainty. In addition, since conductive particles having spike-like protrusions result in greater center distances between particles compared to spherical particles, a high resistance change ratio for the PTC characteristic can be obtained with greater certainty. Moreover, variation between the room temperature resistance value of the thermistor can be minimized compared to using fiber-like particles. Incidentally, using nickel as the constituent material of the conductive particles is preferred from the standpoint of chemical stability, including resistance to oxidation. Thus, the conductive particles used for the organic PTC thermistor of the invention are most preferably nickel particles having spike-like protrusions.

According to the invention it is possible to provide an organic PTC thermistor with an adequately low room temperature resistance value, sufficiently large resistance value change ratio for the PTC characteristic, and excellent reliability.

DETAILED DESCRIPTION OF THE PREFERRED EMBODIMENTS

Figure 1:
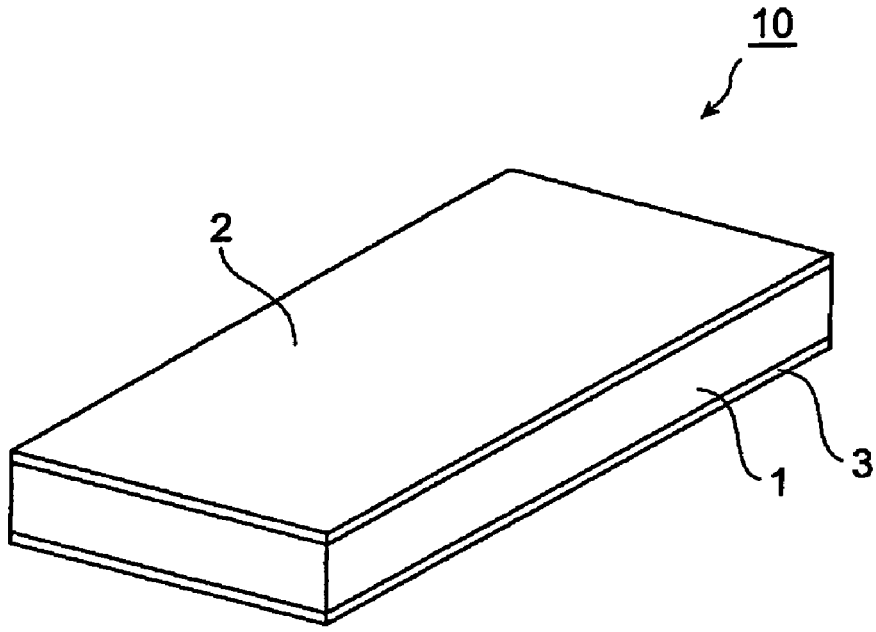
FIG. 1 is a schematic perspective view of a preferred embodiment of an organic PTC thermistor according to the invention.

An organic PTC thermistor of the invention will now be explained in greater detail with reference to the accompanying drawings. Throughout the explanation which follows, identical or corresponding parts will be indicated by like reference numerals and will be explained only once.

FIG. 1 is a schematic perspective view of a preferred embodiment of an organic PTC thermistor according to the invention.

The organic PTC thermistor (hereinafter also referred to as "thermistor") 10 shown in FIG. 1 has a construction provided with a pair of mutually opposing electrodes 2 and 3 and a thermistor element with a positive resistance-temperature characteristic (hereinafter also referred to simply as "thermistor element") 1 situated between the electrode 2 and electrode 3, and also if necessary a lead (not shown) electrically connected to the electrode 2 and a lead (not shown) electrically connected to the electrode 3.

The shapes and materials of the electrode 2 and electrode 3 are not particularly restricted so long as they have electron conductivity sufficient to function as electrodes for a thermistor. The shapes and materials of the leads are also not particularly restricted so long as they have electron conductivity capable of releasing or introducing a charge from the electrode 2 and electrode 3 to the outside.

The thermistor element 1 is formed from a cured body obtained by heating a mixture comprising an epoxy resin, a curing agent and conductive particles. The conductive particles are dispersed in the thermistor element 1 and held by a matrix formed from the epoxy resin and curing agent.

The epoxy resin used to form the thermistor element 1 is not particularly restricted, but if the curing agent described hereunder does not impart flexibility to the cured body, the epoxy resin must be one which imparts flexibility to the cured body. As examples of epoxy resins for the invention there may be mentioned those having an average of two or more epoxy groups per molecule. For example, there may be mentioned polyhydric phenols such as bisphenol A, bisphenol F, bisphenol AD, catechols and resorcinols, or polyglycidyl ethers obtained by reaction between a polyhydric alcohol such as glycerin or polyethylene glycol and epichlorhydrin, glycidyl ether esters obtained by reaction between a hydroxycarboxylic acid such as p-hydroxybenzoic acid or β-hydroxynaphthoic acid and epichlorhydrin, polyglycidyl esters obtained by reaction between a polycarboxylic acid such as phthalic acid or terephthalic acid and epichlorhydrin, epoxidated phenol-novolac resins, epoxidated cresol-novolac resins and dicyclopentadiene-type epoxy resins.

According to this embodiment, a compound represented by the following general formula (1) is preferred for use as the main epoxy resin.

(1)

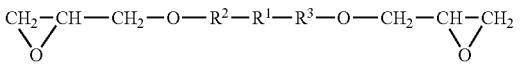

In formula (1), $R^1$, $R^2$ and $R^3$ each represent a single bond or a divalent organic group and at least one from among $R^1$, $R^2$ and $R^3$ includes an optionally substituted C2 or greater divalent chain group, or alternatively $R^1$, $R^2$ and $R^3$ in formula (1) each represent a single bond or a divalent organic group and at least one from among $R^2$ and $R^3$ includes an optionally substituted C1 or greater divalent hydrocarbon group bonded to the glycidyl ether group.

As examples of C2 or greater divalent chain groups there may be mentioned divalent organic groups represented by the following general formulas (11) to (14).

$$—(CH_2)_a— \quad (11)$$

where a represents an integer of 2-20.

$$—(CH_2CH_2O)_b— \quad (12)$$

where b represents an integer of 1-20.

$$—(CH_2CH(CH_3)O)_c— \quad (13)$$

or $$—(CH(CH_3)CH_2O)_c— \quad (14)$$

where c represents an integer of 1-20.

In other words, the thermistor element 1 of the organic PTC thermistor 10 of this embodiment has conductive particles dispersed in a matrix formed from an epoxy resin comprising a compound represented by general formula (1) above, and a curing agent. This allows the room temperature resistance value of the organic PTC thermistor to be adequately reduced, allows the resistance value change ratio for the PTC characteristic to be sufficiently increased, and can result in more excellent reliability of the organic PTC thermistor.

The aforementioned effect can be achieved if the epoxy resin used to form the thermistor element 1 is an epoxy resin containing a compound represented by the following general formula (2).

(2)

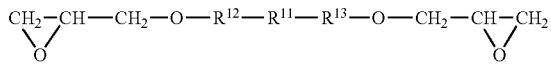

In formula (2), $R^{11}$ represents an optionally substituted C1-20 divalent chain group, and $R^{12}$ and $R^{13}$ may be the same or different and each represents a divalent organic group represented by the following general formula (a) or (b).

$$—(Ar—X^1)— \quad (a)$$

In formula (a), Ar represents an optionally substituted divalent 5-membered cyclic group, 6-membered cyclic group, naphthalene group or anthracene group, and $X^1$ represents a C1 or greater divalent chain group.

$$—Y^1— \quad (b)$$

In formula (b), $Y^1$ represents an optionally substituted C1 or greater divalent chain group containing a carbon atom bonded to the glycidyl ether group.

As examples for $R^{11}$ there may be mentioned chain groups such as $—CH_2—$, $—CH(CH_3)—$, $—C(CH_3)_2—$ and $—C_nH_{2n}—$ (where n is an integer of 2-20).

When $R^{12}$ and $R^{13}$ are the same they may both be, for example, a divalent organic group represented by (a) $—C_4H_6—O—CH_2—CH_2—$ or a divalent organic group represented by (b) $—CH_2—$. When $R^{12}$ and $R^{13}$ are different, for example, one may be a divalent organic group represented by (b) $—CH_2—$, and the other a divalent organic group represented by (b) $—CH_2CH_2—$.

In general formula (2) above, $R^{11}$ is preferably a divalent organic group represented by $—CH_2—$, $—CH(CH_3)$ or $—C(CH_3)_2—$, and $R^{12}$ and $R^{13}$ are preferably divalent organic groups represented by general formula (a) wherein Ar in general formula (a) is $—C_6H_4$. In other words, the compound is preferably represented by the following general formula (21), (22) or (23).

(21)

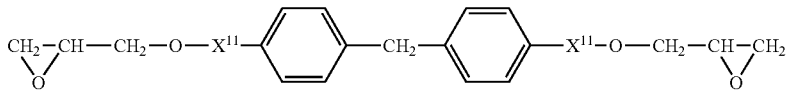

(22)

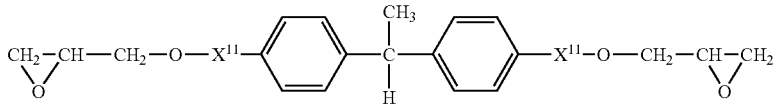

(23)

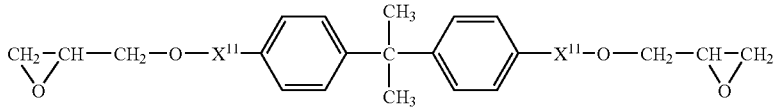

In formulas (21), (22) and (23), $X^{11}$ represents a C1 or greater divalent chain group.

By using such compounds, it is possible to achieve the aforementioned effects of the invention while obtaining with greater certainty an organic PTC thermistor exhibiting excellent heat resistance.

If the epoxy resin used to form the thermistor element 1 is an epoxy resin containing a compound represented by the following general formula (3), it will be possible to adequately reduce the room temperature resistance value of the organic PTC thermistor, to sufficiently increase the resistance value change ratio for the PTC characteristic, and to achieve more excellent reliability of the organic PTC thermistor.

(3)

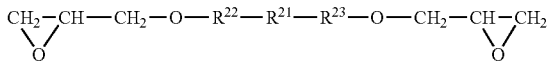

In formula (3), $R^{21}$ represents an optionally substituted C1-20 divalent chain group, and $R^{22}$ and $R^{23}$ each represent a single bond or a divalent organic group, where at least one of $R^{22}$ and $R^{23}$ contains at least one structural unit selected from the group consisting of —$CH_2CH_2O$—, —$CH_2CH(CH_3)O$—, —$CH(CH_3)CH_2O$—, —SiO—, —CH═CH—, —CH═CH—CH═CH—, —CH═C(CN)—, —$CH_2O$—, —$CH_2S$—, —NH—CO—O—, —CO—O—, CH═N— and —O—CO—O—.

If the epoxy resin used to form the thermistor element 1 is an epoxy resin containing a compound represented by the following general formula (4), it will be possible to adequately reduce the room temperature resistance value of the organic PTC thermistor, to sufficiently increase the resistance value change ratio for the PTC characteristic, and to achieve more excellent reliability of the organic PTC thermistor.

(4)

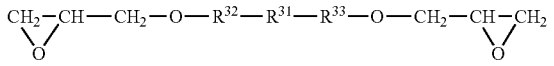

In formula (4), $R^{31}$ represents an optionally substituted C1-20 divalent chain, group, and $R^{32}$ and $R^{33}$ each represent a single bond or a divalent organic group, where at least one of $R^{32}$ and $R^{33}$ contains at least one structural unit selected from the group consisting of —$CH_2$—, —$CH_2CH_2O$—, —$CH_2CH(CH_3)O$—, —$CH(CH_3)CH_2O$—, —SiO—, —CH═CH—, —CH═CH—CH═CH—, —CH═C(CN)—, —$CH_2O$—, —$CH_2S$—, —NH—CO—, —NH—CO—O—, —CO—O— and —CH═N—, wherein the structural unit is bonded to the glycidyl ether group.

As specific examples of $R^{32}$ and $R^{33}$ there may be mentioned divalent organic groups represented by the following general formulas (41) to (44).

$$—(CH_2)_d— \quad (41)$$

where d represents an integer of 1-20.

$$—(CH_2CH_2O)_e— \quad (42)$$

where e represents an integer of 1-20.

$$—(CH_2CH(CH_3)O)_f— \quad (43)$$

$$\text{or } —(CH(CH_3)CH_2O)_f— \quad (44)$$

where f represents an integer of 1-20.

According to this embodiment, at least one of $R^{32}$ and $R^{33}$ in general formula (4) above contains a structural unit represented by the following general formula (5), wherein the structural unit is bonded to the glycidyl ether group.

$$—(R^4—O)_n— \quad (5)$$

In formula (5), $R^4$ represents a C1-20 divalent hydrocarbon group, and n is an integer of 1-10.

This makes it possible to obtain with greater certainty and ease an organic PTC thermistor having the desired room temperature resistance value and the desired resistance change ratio, as well as excellent reliability.

More preferably in general formula (4) above, $R^{31}$ is a divalent organic group represented by —$CH_2$—, —$CH(CH_3)$— or —$C(CH_3)_2$—, and $R^{32}$ and $R^{33}$ are divalent organic groups represented by —$C_4H_6$—$(O\text{-}L)_m$—(where L represents a C1-20 chain group and m is an integer of 1-10).

By using such compounds, it is possible to impart more suitable flexibility to the thermistor element, and obtain with greater certainty and ease an organic PTC thermistor having the desired room temperature resistance value and the desired resistance change ratio, as well as excellent reliability.

There are no particular restrictions on the compounds represented by general formula (1) above so long as they are publicly known compounds. As examples of commercially available epoxy resins having a structural unit wherein at least one of $R^2$ and $R^3$ in formula (1) is —$CH_2CH(CH_3)O$— or —$CH(CH_3)CH_2O$—, there may be mentioned "RIKARESIN BPO20E" (trade name of Shinnihon Rika), "EP4005" (trade name of Asahi Denka Kogyo), "EP4000" (trade name of Asahi Denka Kogyo), and "YD-716" (trade name of Toto Kasei).

As an epoxy resin having a structural unit wherein at least one of $R^2$ and $R^3$ in formula (1) is —CO—O— or —O—CO— there may be mentioned "YD-171" (trade name of Toto Kasei).

As epoxy resins having a structural unit wherein at least one of $R^2$ and $R^3$ in formula (1) is —$CH_2O$—, —$OCH_2$—, —$CH_2S$— or —$SCH_2$— there may be mentioned "RIKARESIN BPO60E" (trade name of Shinnihon Rika), "YH-300" (trade name of Toto Kasei), "PG202" (trade name of Toto Kasei), "EP4085" (trade name of Asahi Denka), "RIKARESIN DME100" (trade name of Shinnihon Rika) and "RIKARESIN DME200" (trade name of Shinnihon Rika)

The epoxy resin used to form the thermistor element 1 may consist solely of one or more compounds represented by general formula (1), (2), (3) or (4) above, or it may be a mixture of a compound represented by general formula (1), (2), (3) or (4) above and another epoxy resin. There are no particular restrictions on epoxy resins other than compounds represented by general formula (1), (2), (3) and (4) above, and for example, there may be mentioned those having an average of two or more epoxy groups per molecule. For example, there may be mentioned polyhydric phenols such as bisphenol A, bisphenol F, bisphenol AD, catechols and resorcinols, or polyglycidyl ethers obtained by reaction between a polyhydric alcohol such as glycerin or polyethylene glycol and epichlorhydrin, glycidyl ether esters obtained by reaction between a hydroxycarboxylic acid such as p-hydroxybenzoic acid or β-hydroxynaphthoic acid and epichlorhydrin, polyglycidyl esters obtained by reaction between a polycarboxylic acid such as phthalic acid or terephthalic acid and epichlorhydrin, epoxidated phenol-novolac resins, epoxidated cresol-novolac resins and dicyclopentadiene-type epoxy resins.

The aforementioned epoxy resins may be used alone or in combinations of two or more different types.

The compounds represented by general formulas (1), (2), (3) and (4) above are preferably used in a proportion of 5-100 parts by weight, and more preferably in a proportion of 10-100 parts by weight, to 100 parts by weight as the total epoxy resin. If the proportion of compounds represented by general formulas (1), (2), (3) and (4) is less than 5 parts by weight, it will tend to be difficult for the obtained organic PTC thermistor to simultaneously exhibit the desired room temperature resistance value and the desired resistance change ratio, and the reliability will tend to be unsatisfactory.

There are no particular restrictions on the curing agent used to form the thermistor element 1 so long as it can react with the epoxy resin to form a cured body, but if the epoxy resin does not impart flexibility to the cured body, the curing agent must be one which imparts flexibility to the cured body. As curing agents for the invention there may be mentioned publicly known curing agents such as acid anhydrides, aliphatic polyamines, aromatic polyamines, polyamides, phenols, polymercaptanes, tertiary amines and Lewis acid complexes.

Among the aforementioned curing agents, an acid anhydride is preferably used for this embodiment. Using an acid anhydride will tend to reduce the initial room temperature resistance value of the organic PTC thermistor compared to using an amine-based curing agent.

Whether or not a certain compound qualifies as one which "imparts flexibility to the cured body" for this embodiment may be judged by whether or not it satisfies the condition determined by, for example, the following method. The condition is that for a mixture of the epoxy resin and the acid anhydride-containing curing agent in an equivalent ratio of 1:1, heat treated to form a cured body, the flexural modulus E3 (Pa) of the obtained cured body at 25° C. must satisfy inequality (B) below with respect to the flexural modulus E2 (Pa) at 25° C. of a cured body obtained by mixing the same epoxy resin and methylhexahydrophthalic anhydride as the curing agent in an equivalent ratio of 1:1 and heat treating it under the same conditions.

$$(E3/E2)<1 \quad \text{(B)}$$

Here, E3 and E2 are the values measured based on a flexural modulus measuring method.

An acid anhydride satisfying such condition may be judged as "an acid anhydride which imparts flexibility to the cured body" according to this embodiment.

By using an acid anhydride-containing curing agent which imparts flexibility to the cured body, it is possible to obtain an organic PTC thermistor having both the desired room temperature resistance value and the desired resistance change ratio, as well as excellent reliability.

For this embodiment, (E3/E2) is preferably 0.2-0.8. If (E3/E2) is greater than 0.8 it will tend to be difficult to achieve the effect of the invention, and if it is less than 0.2, the mechanical strength of the thermistor element will tend to be lower.

Addition of the acid anhydride to the curing agent of this embodiment has the effect of relatively reducing the room temperature resistance value of the organic PTC thermistor employing the epoxy resin, while also imparting heat resistance and reducing the viscosity for improved workability.

As acid anhydrides which may be suitably used for this embodiment there may be mentioned compounds represented by the following general formula (I), or compounds including one or more structural units represented by one or more of the following general formulas (II) to (IV).

(I)

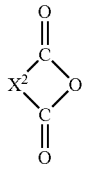

In formula (I), $X^2$ represents a divalent organic group with at least one C4 or greater hydrocarbon group. The C4 or greater hydrocarbon group may be a saturated hydrocarbon group or an unsaturated hydrocarbon group, and it may have a linear or branched structure.

(II)

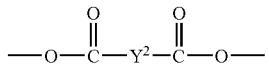

In formula (II), $Y^2$ represents a C4 or greater divalent hydrocarbon group.

(III)

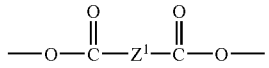

In formula (III), $Z^1$ represents a C2 or greater divalent hydrocarbon group.

(IV)

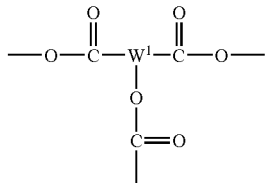

In formula (IV), $W^1$ represents a C3 or greater trivalent hydrocarbon group.

As examples of compounds represented by general formula (I) above there may be mentioned acid anhydrides represented by the following general formulas (V) and (VI).

(V)

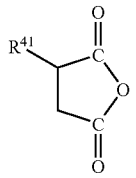

In formula (V), $R^{41}$ represents a C4-20 saturated or unsaturated hydrocarbon group.

(VI)

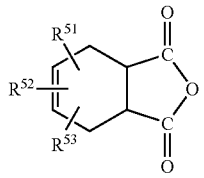

In formula (VI), $R^{51}$ to $R^{53}$ may be the same or different and each represents a C4-20 saturated or unsaturated hydrocarbon group.

As examples of compounds represented by general formula (II) above there may be mentioned acid anhydrides represented by the following general formula (VII).

(VII)

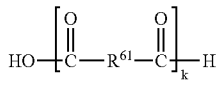

In formula (VII), $R^{61}$ represents a C4 or greater divalent hydrocarbon group. The hydrocarbon group may optionally have a substituent such as alkyl or phenyl so long as the number of carbon atoms of the main chain is 4 or greater. Also, k in formula (VII) represents an integer of 1-20.

As examples of compounds represented by general formula (III) above there may be mentioned acid anhydrides represented by the following general formula (VIII).

(VIII)

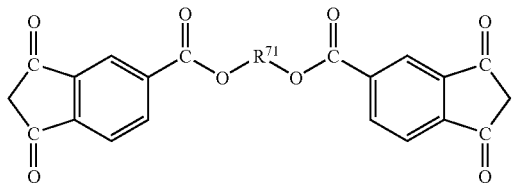

In general formula (VIII) $R^{71}$ represents a C2 or greater divalent hydrocarbon group.

As examples of compounds represented by general formula (III) above there may also be mentioned acid anhydrides represented by the following general formula (IX).

(IX)

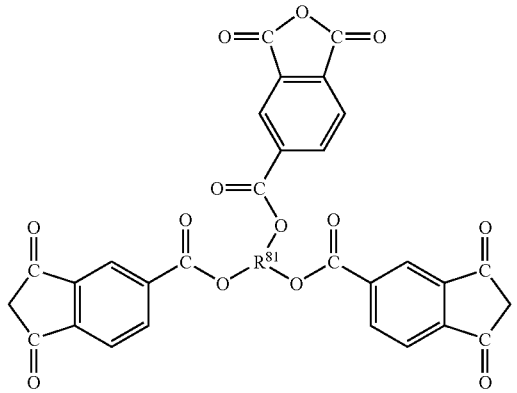

In formula (IX), $R^{81}$ represents a C3 or greater trivalent hydrocarbon group.

As additional examples of acid anhydrides which can impart flexibility to the cured body there may be mentioned aliphatic acid anhydrides such as dodecenylsuccinic anhydride, polyadipic anhydride, polyazelaic anhydride, polysebacic anhydride, poly(ethyloctadecanedioic)anhydride, poly(phenylhexadecanedioic)anhydride and 2,4-diethylglutaric anhydride, or aromatic acid anhydrides such as ethyleneglycol bisanhydrotrimellitate and glycerol tristrimellitate. These may be used alone or in combinations of two or more.

By using such compounds, it is possible to obtain with greater certainty and ease an organic PTC thermistor having the desired room temperature resistance value and the desired resistance change ratio, as well as excellent reliability.

The curing agent used to form the thermistor element 1 may consist solely of one or more of the aforementioned acid anhydrides, or it may be a mixture of one or more of the aforementioned acid anhydrides with one or more other curing agents. There are no particular restrictions on curing agents other than acid anhydrides which impart flexibility to the cured body so long as they can react with the epoxy resin to form a cured body, and as examples there may be mentioned publicly known curing agents such as acid anhydrides, aliphatic polyamines, aromatic polyamines, polyamides, phenols, polymercaptanes, tertiary amines and Lewis acid complexes, that do not satisfy formula (I) above.

The aforementioned curing agents may be used alone or in combinations of two or more.

The acid anhydride which imparts flexibility to the cured body is preferably used in a proportion of 5-100 parts by weight, and more preferably in a proportion of 20-100 parts by weight, to 100 parts by weight as the total curing agent. If the proportion of the acid anhydride which imparts flexibility to the cured body is less than 5 parts by weight, it will tend to be difficult for the obtained organic PTC thermistor to simultaneously exhibit the desired room temperature resistance value and the desired resistance change ratio.

The proportion of the curing agent used to form the thermistor element 1 is preferably 0.5-1.5 and more preferably 0.8-12, as the equivalent ratio with respect to the total epoxy resin. If the equivalent ratio of the curing agent is less than 0.5 or greater than 1.5 with respect to the epoxy resin, the increased unreacted epoxy groups and acid anhydride groups will tend to result in lower mechanical strength of the thermistor element and a reduced resistance change ratio for the PTC characteristic of the thermistor.

The conductive particles included in the thermistor element 1 are not particularly restricted so long as they have electron conductivity, and for example, there may be used carbon black, graphite, metal particles of various shapes and ceramic-based conductive particles. As materials for metal particles there may be mentioned copper, aluminum, nickel, tungsten, molybdenum, silver, zinc, cobalt and nickel-plated copper powder. As materials for ceramic-based conductive particles there may be mentioned TiC and WC. These materials maybe used alone or in combinations of two or more different types.

Metal particles are preferably used for the organic PTC thermistor of this embodiment. When metal particles are used as the conductive particles it is possible to adequately ensure the resistance change ratio of the thermistor and further reduce the room temperature resistance value, and this is preferred when, for example, the thermistor of the invention is to be used as an overcurrent protection element. The constituent material of the metal particles is preferably nickel from the standpoint of chemical stability, including resistance to oxidation.

The shapes of the conductive particles are not particularly restricted, and they may be in the form of spheres, flakes, fibers, rods or the like, but particles having surface spike-like protrusions are preferred. For the organic PTC thermistor of this embodiment, using conductive particles having spike-like protrusions will facilitate flow of the tunnel current between adjacent particles, so that the resistance change ratio of the organic PTC thermistor can be adequately ensured and the room temperature resistance value can be further reduced. In addition, since conductive particles having spike-like protrusions result in greater center distances between particles compared to spherical particles, a high resistance change ratio for the PTC characteristic can be obtained. Moreover, variation between the room temperature resistance value of the thermistor can be minimized compared to using fiber-like particles.

Conductive particles having spike-like protrusions may be in the form of a powder comprising separate individual particles (primary particles), but preferably 10-1000 primary particles are linked in chains to form filamentous secondary particles. By forming such filamentous secondary particles it is possible to obtain lower room temperature resistance and a stable room temperature resistance value with less variation. Also, from the standpoint of chemical stability the material is preferably a metal, more preferably comprising nickel as the major component. The area to weight ratio is preferably 0.3-3.0 $m^2/g$ and the apparent density is preferably no greater than 3.0 $g/cm^3$. The "area to weight ratio" is the specific surface area determined by nitrogen gas adsorption based on the BET one point method.

The mean particle size of the primary particles is preferably 0.1-7.0 μm and more preferably 0.5-5.0 μm. The mean particle size is measured by the Fisher subsieve method.

As examples of commercially available conductive particles having spike-like protrusions there may be mentioned "INCO Type210", "INCO Type255", "INCO Type270" and "INCO Type287" (all trade names of INCO Ltd.).

The proportion of conductive particles in the thermistor element 1 is preferably 50-90 wt % and more preferably 60-80 wt % as the content in the thermistor element. If the proportion of conductive particles is less than 50 wt % it will tend to be difficult to achieve a low room temperature resistance value, and if it is greater than 90 wt % it will tend to be difficult to achieve a larger resistance change ratio for the PTC characteristic.

According to this embodiment, an additive such as a curing accelerator may be further added to the mixture comprising the epoxy resin, curing agent and conductive particles. Addition of a curing accelerator can lower the curing temperature for curing of the mixture and shorten the time required for curing.

As examples of curing accelerators there may be mentioned commonly used curing accelerators such as tertiary amines, amine adduct compounds, imidazole adduct compounds, boric acid esters, Lewis acids, organic metal compounds, organic acid metal salts and imidazoles. Among these, imidazole adduct epoxy compounds are preferred for use as imidazole adduct compounds. They facilitate control of the curing rate and result in lower heat. generation compared to tertiary amines or amine adduct compounds as curing accelerators, so that it is possible to prevent with greater certainty a level of heat generation which could cause carbonization of the resin forming the thermistor element 1.

The amount of additives added is not particularly restricted so long as it is in a range which does not impede the effect of the invention.

An example of a production process for an organic PTC thermistor of the invention will now be explained.

First, prescribed amounts of the epoxy resin, curing agent, conductive particles and if necessary, additives such as a curing accelerator are combined (mixing step). The apparatus used for the mixing step may be a publicly known apparatus such as a stirrer, disperser, mill or the like. The mixing time is not particularly restricted but will normally be from 10 to 60 minutes to allow thorough dispersion of the components.

Vacuum defoaming is preferably carried out if air bubbles are to be included during the mixing treatment. For adjustment of the viscosity, a reactive diluent or an ordinary solvent may be used. As examples of such solvents there may be mentioned IPA, acetone, methanol, methyl ethyl ketone (MEK), methyl isobutyl ketone (MIBK), toluene, xylene, dimethylformamide. (DMF), dimethylsulfoxide (DMSO), TBF, cellosolve acetate, ethyl acetate and the like.

The obtained mixture is then coated onto a metal foil as the electrode using a method such as screen printing. The coated mixture is then sandwiched using another metal foil and press molded to form a sheet. The mixture may also be cast between metal foil electrodes such as nickel or copper to form a sheet.

The obtained sheet is then subjected to heat treatment for curing (curing step).

Alternatively, the mixture alone may be formed into a sheet using, for example, a doctor blade method and cured, and then conductive paste or the like coated thereon to form electrodes.

The obtained cured sheet may then be punched into the desired shape (for example, 3.6 mm×9 mm) to obtain a thermistor (punching step). The punching method used is not particularly restricted so long as it is a punching method ordinarily used for organic PTC thermistors.

If necessary, the surfaces of the electrodes of the thermistor obtained from the punching step may each be bonded to respective leads to fabricate a thermistor with leads. The lead bonding method used is not particularly restricted so long as it is one commonly employed for fabrication of organic PTC thermistors.

The present invention is in no way limited to the preferred embodiments explained above for the organic PTC thermistor of the invention and production process therefor.

Also, the organic PTC thermistor may have a laminated construction comprising a plurality of thermistor elements.

The organic PTC thermistor of the invention may be utilized as an overcurrent/overheat protection element, autoregulating heating element, temperature sensor or the like.

EXAMPLES

The present invention will now be explained in greater detail through the following examples and comparative examples, with the understanding that these examples are in no way limitative on the invention.

Example 1

A stirrer was used for stirred mixing of 100 parts by weight of an epoxy resin comprising the structural unit —$CH_2CH(CH_3)O$— or —$CH(CH_3)CH_2O$— in the molecule ("BPO20E", trade name of Shinnihon Rika; epoxy equivalents: 314 g/eq), 54 parts by weight of methyltetrahydrophthalic anhydride as the curing agent ("B570", trade name of Dainippon Ink Corporation; acid anhydride equivalents: 168 g/eq) (epoxy resin/curing agent equivalent ratio=1/1) and 1 part by weight of an imidazole adduct epoxy compound as a curing accelerator ("PN-40J", trade name of Ajinomoto Fine Techno). Also, filamentous nickel powder ("Type255 Nickel Powder", trade name of INCO Ltd.; mean particle size: 2.2-2.8 μm, apparent density: 0.5–0.65 g/cm$^3$, area to weight ratio: 0.68 m$^2$/g) was added as conductive particles to 75 wt % of the mixture, which was further stirred to prepare a final mixture.

The obtained mixture was coated onto a Ni foil (thickness: 25 μm) to form a coating with a thickness of 0.5 mm, and then the coated film was sandwiched with another Ni foil prior to press molding. The combination was placed in an oven and held for 5 hours at a temperature of 150° C. for curing treatment, to obtain a cured sheet sandwiched between Ni foil electrodes.

The obtained cured sheet was punched into a 3.6×9.0 mm shape to obtain an organic PTC thermistor.

The thermistor was heated in a thermostatic chamber from room temperature (25° C.) to 200° C. at 3° C./min and then cooled, and the resistance value was measured at a prescribed temperature by the four-terminal method to obtain a temperature-resistance curve.

The initial room temperature resistance value was $1.0\times10^{-3}$ Ω ($7.0\times10^{-3}$ Ω·cm). Also, the resistance increased rapidly near 150° C., and the resistance change ratio was seven digits ($10^7$) or greater. After heating and cooling, the room temperature resistance value was $4.0\times10^{-3}$ Ω ($2.8\times10^{-2}$ Ω·cm). The room temperature resistance value after 10 cycles of a continuous load test at 6V-10 A (1 cycle=10 seconds ON, 350 seconds OFF) was 0.010 Ω ($7.0\times10^{-2}$ Ω·cm). These results are summarized in Table 1.

No deformation was seen in the thermistor even after allowing it to stand at a high temperature of about 200° C. and restoring it to room temperature.

Example 2

An organic PTC thermistor was obtained in the same manner as Example 1, except that 50 parts by weight each of a bisphenol A type epoxy resin ("EPICLON850", trade name of Dainippon Ink Corporation; epoxy equivalents: 190 g/eq) and an epoxy resin comprising the structural unit —$CH_2CH(CH_3)O$— or —$CH(CH_3)CH_2O$— in the molecule ("E4005", trade name of Asahi Denka; epoxy equivalents: 510 g/eq) were used as epoxy resins, and the curing agent was used at 60 parts by weight to 100 parts by weight of the total epoxy resin (epoxy resin/curing agent equivalent ratio=1/1).

A temperature-resistance curve was plotted for the obtained thermistor by the same method as Example 1. The initial room temperature resistance value was $2.0\times10^{-3}$ Ω ($1.4\times10^{-2}$ Ω·cm). Also, the resistance increased rapidly near 150° C., and the resistance change ratio was eight digits ($10^8$) or greater. After heating and cooling, the room temperature resistance value was $8.0\times10^{-3}$ Ω ($5.6\times10^{-2}$ Ω·cm). The room temperature resistance value after 10 cycles of a continuous load test at 6V-10 A (1 cycle=10 seconds ON, 350 seconds OFF) was 0.016 Ω ($1.1\times10^{-I}$ Ω·cm). These results are summarized in Table 1.

No deformation was seen in the thermistor even after allowing it to stand at a high temperature of about 200° C. and restoring it to room temperature.

Comparative Example 1

An organic PTC thermistor was obtained in the same manner as Example 1, except that 100 parts by weight of a bisphenol A type resin ("EPICLON850", trade name of Dainippon Ink Corporation; epoxy equivalents: 190 g/eq) was used as the epoxy resin, and the curing agent was used at 88 parts by weight to 100 parts by weight of the epoxy resin (epoxy resin/curing agent equivalent ratio=1/1).

A temperature-resistance curve was plotted for the obtained thermistor by the same method as Example 1. The initial room temperature resistance value was $2.0\times10^{-3}$ Ω ($1.4\times10^{-2}$ Ω·cm). However, no significant resistance change was observed even with varying temperature, and the PTC characteristic was insufficient. These results are summarized in Table 1.

Comparative Example 2

An organic PTC thermistor was obtained in the same manner as Example 1, except that conductive particles were added to 60 wt % of the mixture.

A temperature-resistance curve was plotted for the obtained thermistor by the same method as Example 1. The resistance increased rapidly near 150° C., and the resistance change ratio was eight digits ($10^8$) or greater. The initial room temperature resistance value was $1.0\times10^{-2}$ Ω ($1.3\times10^{-1}$ Ω·cm). After heating and cooling, the room temperature resistance value was $2.0\times10^{-2}$ Ω ($2.6\times10^{-1}$ Ω·cm). The room temperature resistance value after 10 cycles of a continuous load test at 6V-10 A (1 cycle=10 seconds ON, 350 seconds OFF) was 0.15 Ω (1.06 Ω·cm). These results are summarized in Table 1.

TABLE 1

| | Initial room temperature resistance value (Ω) | Resistance change ratio (digits) | Room temperature resistance value after heating/cooling (Ω) | Room temperature resistance value after continuous load test (Ω) |
|---|---|---|---|---|
| Example 1 | $1.0\times10^{-3}$ ($7.0\times10^{-3}$) | ≧7 | $4.0\times10^{-3}$ ($2.8\times10^{-2}$) | $1.0\times10^{-2}$ ($7.0\times10^{-2}$) |

TABLE 1-continued

| | Initial room temperature resistance value (Ω) | Resistance change ratio (digits) | Room temperature resistance value after heating/cooling (Ω) | Room temperature resistance value after continuous load test (Ω) |
|---|---|---|---|---|
| Example 2 | $2.0 \times 10^{-3}$ ($1.4 \times 10^{-2}$) | ≧8 | $8.0 \times 10^{-3}$ ($5.6 \times 10^{-2}$) | $1.6 \times 10^{-2}$ ($1.1 \times 10^{-1}$) |
| Comp. Ex. 1 | $2.0 \times 10^{-3}$ ($1.4 \times 10^{-2}$) | No PTC characteristic | — | — |
| Comp. Ex. 2 | $1.0 \times 10^{-2}$ ($1.3 \times 10^{-1}$) | ≧8 | $1.0 \times 10^{-2}$ ($2.6 \times 10^{-1}$) | $1.5 \times 10^{-1}$ (1.06) |

In Table 1, the values in parentheses in the columns for initial room temperature resistance value, room temperature resistance value after beating/cooling and room temperature resistance value after continuous load test represent the values expressed in units of Ω·cm.

As shown in Table 1, the organic PTC thermistors of Examples 1 and 2 were confirmed to simultaneously exhibit adequately low room temperature resistance values and sufficiently high resistance change ratios. Also, the recovery of the room temperature resistance value after heating/cooling and the recovery of the room temperature resistance value after the continuous load test were satisfactory, thereby confirming excellent reliability.

Example 3

A stirrer was used for stirred mixing of 100 parts by weight of a bisphenol A type epoxy resin ("EPICLON850", trade name of Dainippon Ink Corporation; epoxy equivalents: 190 g/eq) as an epoxy resin, 140 parts by weight of dodecenylsuccinic anhydride ("RIKASID DDSA", wade name of Shinnihon Rika; acid anhydride equivalents: 266 g/eq) as a curing agent (epoxy resin/curing agent equivalent ratio=1/1) and 1 part by weight of an imidazole adduct epoxy compound as a curing accelerator ("PN-40J", trade name of Ajinomoto Fine Techno). Also, filamentous nickel powder ("Type255 Nickel Powder", trade name of INCO Ltd.; mean particle size: 2.2-2.8 μm, apparent density: 0.5-0.65 g/cm$^3$, area to weight ratio: 0.68 m$^2$/g) was added as conductive particles to 75 wt % of the mixture, which was further stirred to prepare a final mixture.

The obtained mixture was coated onto a Ni foil (thickness: 25 μm) by a printing method to form a coating with a thickness of 0.5 mm, and then the coated film was sandwiched with another Ni foil prior to press molding. The combination was placed in an oven and held for 300 minutes at a temperature of 150° C. for curing treatment, to obtain a cured sheet sandwiched between Ni foil electrodes.

The obtained cured sheet was punched into a 3.6×9.0 mm shape to obtain an organic PTC thermistor for Example 3.

The thermistor was heated in a thermostatic chamber from room temperature (25° C.) to 200° C. at 3° C./min and then cooled, and the resistance value was measured at a prescribed temperature by the four-terminal method to obtain a temperature-resistance curve.

The organic PTC thermistor of Example 3 had an initial room temperature resistance value of $3.0\times10^{-3}$ Ω ($1.3\times10^{-2}$ Ω·cm). Also, the resistance increased rapidly near 130° C., and the resistance change ratio was seven digits ($10^7$) or greater. After heating and cooling, the room temperature resistance value was $6.0\times10^{-3}$ Ω ($3.9\times10^{-2}$ Ω·cm). These results are summarized in Table 2.

When the organic PTC thermistor of Example 3 was allowed to stand at a high temperature of about 200° C. and then removed to a room temperature environment, no warping or deformation of the Ni foil electrodes or extrusion of the element from the punched wall sides was seen, and no deformation of the thermistor was found.

Example 4

An organic PTC thermistor for Example 4 was obtained in the same manner as Example 3, except that 100 parts by weight of a bisphenol F type epoxy resin ("EPICLON830", trade name of Dainippon Ink Corporation; epoxy equivalents: 175 g/eq) was used instead of the bisphenol A type as the epoxy resin, and the curing agent was used at 152 parts by weight to 100 parts by weight of the epoxy resin (epoxy resin/curing agent equivalent ratio=1/1).

A temperature-resistance curve was plotted for the thermistor of Example 4 by the same method as Example 3. The initial room temperature resistance value was $2.0\times10^{-3}$ Ω ($1.3\times10^{-2}$ Ω·cm). Also, the resistance increased rapidly near 130° C., and the resistance change ratio was six digits ($10^6$) or greater. After heating and cooling, the room temperature resistance value was $4.0\times10^{-3}$ Ω ($2.6\times10^{-2}$ Ω·cm). These results are summarized in Table 2.

When the organic PTC thermistor of Example 4 was allowed to stand at a high temperature of about 200° C. and then removed to a room temperature environment, no warping or deformation of the Ni foil electrodes or extrusion of the element from the punched wall sides was seen, and no deformation of the thermistor was found.

Example 5

An organic PTC thermistor for Example 5 was obtained in the same manner as Example 3, except that octenylsuccinic anhydride ("OSA", trade name of Sanyo Kasei Kogyo; acid anhydride equivalents: 258 g/eq) was used instead of dodecenylsuccinic anhydride as the curing agent at 136 parts by weight to 100 parts by weight of the epoxy resin (epoxy resin/curing agent equivalent ratio=1/1).

A temperature-resistance curve was plotted for the thermistor of Example 5 by the same method as Example 3. The initial room temperate resistance value was $3.0\times10^{-3}$ Ω ($1.9\times10^{-2}$ Ω·cm). Also, the resistance increased rapidly near 130° C., and the resistance change ratio was seven digits ($10^7$) or greater. After heating and cooling, the room temperature resistance value was $4.0\times10^{-3}$ Ω ($2.6\times10^{-2}$ Ω·cm) These results are summarized in Table 2.

When the organic PTC thermistor of Example 5 was allowed to stand at a high temperature of about 200° C. and then removed to a room temperature environment, no warping of the electrode foil surfaces or extrusion of the PTC element from the punched wall sides was seen, and no deformation of the thermistor was found.

Comparative Example 3

An organic PTC thermistor for Comparative Example 3 was obtained in the same manner as Example 3, except that methyltetrahydrophthalic anhydride ("B570", trade name of Dainippon Ink Corporation; acid anhydride equivalents; 168 g/eq) was used instead of dodecenylsuccinic anhydride as the curing agent at 88 parts by weight to 100 parts by weight of the epoxy resin (epoxy resin/curing agent equivalent ratio=1/1).

A temperature-resistance curve was plotted for the thermistor of Comparative Example 3 by the same method as Example 3. The initial room temperature resistance value was $3.0\times10^{-3}$ Ω ($1.9\times10^{-2}$ Ω·cm). However, the resistance change ratio was less than one digit ($10^1$) even with temperature variation, and a satisfactory PTC characteristic was not achieved. These results are summarized in Table 2.

Comparative Example 4

An organic PTC thermistor for Comparative Example 4 was obtained in the same manner as Example 3, except that methylhexahydrophthalic anhydride ("B650", trade name of Dainippon Ink Corporation; acid anhydride equivalents: 166 g/eq) was used instead of dodecenylsuccinic anhydride as the curing agent at 88 parts by weight to 100 parts by weight of the epoxy resin (epoxy resin/curing agent equivalent ratio=1/1).

A temperature-resistance curve was plotted for the thermistor of Comparative Example 4 by the same method as Example 3. The initial room temperature resistance value was $4.0\times10^{-3}$ Ω ($2.6\times10^{-2}$ Ω·cm). However, the resistance change ratio was about one digit ($10^1$) even with temperature variation, and a satisfactory PTC characteristic was not achieved. These results are summarized in Table 2.

Comparative Example 5

An organic PTC thermistor for Comparative Example 5 was obtained in the same manner as Example 3, except that 100 parts by weight of a bisphenol F type epoxy resin ("EPICLON830", trade name of Dainippon Ink Corporation; epoxy equivalents: 175 g/eq) was used instead of the bisphenol A type as the epoxy resin, and methyltetrahydrophthalic anhydride ("B570", trade name of Dainippon Ink Corporation; acid anhydride equivalents: 168 g/eq) was used instead of dodecenylsuccinic anhydride as the curing agent at 96 parts by weight to 100 parts by weight of the epoxy resin (epoxy resin/curing agent equivalent ratio=1/1).

A temperature-resistance curve was plotted for the thermistor of Comparative Example 5 by the same method as Example 3. The initial room temperature resistance value was $3.0\times10^{-3}$ Ω ($1.9\times10^{-2}$ Ω·cm). However, the resistance change ratio was less than one digit ($10^1$) even with temperature variation, and a satisfactory PTC characteristic was not achieved. These results are summarized in Table 2.

TABLE 2

| | Initial room temperature resistance value (Ω) | Resistance change ratio (digits) | Room temperature resistance value after heating/cooling (Ω) |
|---|---|---|---|
| Example 3 | $2.0\times10^{-3}$ ($1.3\times10^{-2}$) | ≧7 | $6.0\times10^{-3}$ ($3.9\times10^{-2}$) |
| Example 4 | $2.0\times10^{-3}$ ($1.3\times10^{-2}$) | ≧6 | $4.0\times10^{-3}$ ($2.6\times10^{-2}$) |
| Example 5 | $2.0\times10^{-3}$ ($1.3\times10^{-2}$) | ≧7 | $4.0\times10^{-3}$ ($2.6\times10^{-2}$) |
| Comp. Ex. 3 | $3.0\times10^{-3}$ ($1.9\times10^{-2}$) | <1 | — |
| Comp. Ex. 4 | $4.0\times10^{-3}$ ($2.6\times10^{-2}$) | 1 | — |
| Comp. Ex. 5 | $3.0\times10^{-3}$ ($1.9\times10^{-2}$) | <1 | — |

In Table 2, the values in parentheses in the columns for initial room temperature resistance value and room temperature resistance value after heating/cooling represent the values expressed in units of Ω·cm.

As shown in Table 2, the organic PTC thermistors of Examples 3-5 were confirmed to simultaneously exhibit adequately low room temperature resistance values and sufficiently high resistance change ratios. Also, the recovery of the room temperature resistance value after heating/cooling was satisfactory, thereby confirming excellent reliability.

What is claimed is:

1. An organic positive temperature coefficient thermistor provided with a pair of mutually opposing electrodes and a thermistor element with a positive resistance-temperature characteristic situated between said pair of electrodes, wherein said thermistor element contains a cured body derived from a mixture comprising an epoxy resin, a curing agent and conductive particles, and there is included in said epoxy resin and/or curing agent a compound which imparts flexibility to said cured body, and said epoxy resin contains a compound represented by the following general formula (2):

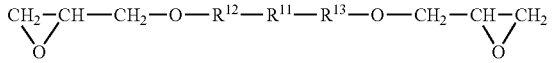

(2)

wherein $R^{11}$ represents an optionally substituted C1-20 divalent chain group which is saturated hydrocarbon groups or unsaturated hydrocarbon groups optionally including hetero atoms within the main chain skeleton, and $R^{12}$ and $R^{13}$ may be the same or different and each represents a divalent organic group represented by the following general formula (a)

$$—(Ar—X^1)— \quad (a)$$

wherein Ar represents an optionally substituted divalent 5-membered cyclic group, 6-membered cyclic group, naphthalene group or anthracene group, and $X^1$ represents a C1 or greater divalent chain group.

2. An organic positive temperature coefficient thermistor according to claim 1, wherein in general formula (2), $R^{11}$ is a divalent organic group represented by $—CH_2—$, $—CH(CH_3)—$ or $—C(CH_3)_2—$, and $R^{12}$ and $R^{13}$ are divalent organic groups represented by general formula (a) wherein Ar in general formula (a) is $—C_6H_4—$.

3. An organic positive temperature coefficient thermistor according to claim 1, wherein the component which imparts flexibility to said cured body in said curing agent comprises an acid anhydride.

4. An organic positive temperature coefficient thermistor according to claim 3, wherein said acid anhydride is a compound represented by the following general formula (I), or a compound comprising one or more structural units represented by one or more of the following general formulas (II) to (IV)

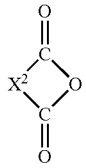

(I)

[wherein $X^2$ represents a divalent organic group with at least one C4 or greater hydrocarbon group]

(II)

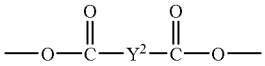

[wherein $Y^2$ represents a C4 or greater divalent hydrocarbon group]

(III)

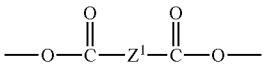

[wherein $Z^1$ represents a C2 or greater divalent hydrocarbon group]

(IV)

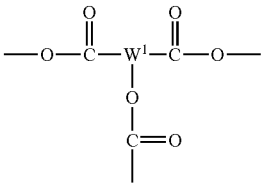

[wherein $W^1$ represents a C3 or greater trivalent hydrocarbon group].

5. An organic positive temperature coefficient thermistor according to claim 3, wherein said acid anhydride is one or more selected from the group consisting of dodecenylsuccinic anhydride, polyadipic anhydride, polyazelaic anhydride, polysebacic anhydride, poly(ethyloctadecanedioic) anhydride, poly(phenylhexadecanedioic) anhydride, 2,4-diethylglutaric anhydride, ethyleneglycol bisanhydrotrimellitate and glycerol tristrimellitate.

6. An organic positive temperature coefficient thermistor according to claim 1, wherein said conductive particles are nickel particles having spike-like protrusions.

* * * * *